US006103042A

United States Patent [19]

Hatada et al.

[11] Patent Number: 6,103,042

[45] Date of Patent: Aug. 15, 2000

[54] IMAGE TRANSFER SHEET AND IMAGE TRANSFER METHOD USING THE SAME

[75] Inventors: Shigeo Hatada; Keishi Taniguchi, both of Shizuoka, Japan

[73] Assignee: Ricoh Company, Ltd., Tokyo, Japan

[21] Appl. No.: 09/083,045

[22] Filed: May 22, 1998

[30] Foreign Application Priority Data

May 22, 1997 [JP] Japan ..... 9-132228
May 18, 1998 [JP] Japan ..... 10-135399

[51] Int. Cl.[7] ..... B41M 5/00; B41M 5/025; B41M 5/40

[52] U.S. Cl. ..... 156/235; 347/105; 428/195; 428/341; 428/447; 428/484; 428/488.1; 428/913; 428/914

[58] Field of Search ..... 8/471; 156/235; 428/195, 913, 914, 341, 447, 488.1; 430/200; 427/121; 503/227; 347/105, 213, 221

[56] References Cited

U.S. PATENT DOCUMENTS 5,448,282 9/1995 Imai et al. ..... 347/213

*Primary Examiner*—Bruce H. Hess
*Attorney, Agent, or Firm*—Oblon, Spivak, McClelland, Maier & Neustadt, P.C.

[57] ABSTRACT

An image transfer sheet has a support, a transfer layer formed on one side of the support, and a backing layer formed on the other side of the support, opposite to the transfer layer with respect to the support, the backing layer containing a silicone material which is in a solid state at room temperature. An image is formed on the transfer layer of the above-mentioned image transfer sheet by various image forming methods, and the image-bearing transfer layer of the image transfer sheet is transferred to an image-receiving member by the application of heat and/or pressure thereto.

11 Claims, No Drawings

IMAGE TRANSFER SHEET AND IMAGE TRANSFER METHOD USING THE SAME

BACKGROUND OF THE INVENTION

Field of the Invention

The present invention relates to an image transfer sheet comprising a support, a transfer layer provided on one side of the support and a backing layer provided on the other side of the support, and an image transfer method using such an image transfer sheet. An image can be formed on the transfer layer of the image transfer sheet using a variety of image forming apparatus, and the thus formed image-bearing transfer layer can be transferred to other image-receiving members such as cloth, canvas, plastic goods, paper, wood, leather, glass, earthenware and metal.

In the present invention, the image can be formed on the image transfer sheet, for example, using the following image forming apparatus:

1) an electrophotographic copying apparatus capable of producing a toner image by the xerography comprising an electrostatic image transfer step,
2) a printer capable of transferring a thermofusible ink image or sublimation-type dye image by the thermal image transfer recording method, and
3) an ink-jet printer capable of producing an aqueous ink image or a thermofusible ink image by the ink-jet process.

Discussion of Background

In recent years, with the spread and development of the copying and printing apparatus, not only the originally-developed use of each apparatus, that is, to produce an image to a sheet of plain paper, but also new uses have been actively studied based on the applied functions of the apparatus.

For example, there is proposed a method of transferring an image formed on an image transfer sheet using the copying and printing apparatus to an image-receiving member such as cloth, leather, canvas, plastics, wood, glass, earthenware or metal, and fixing the image thereto. To be more specific, the above-mentioned image transfer method can be effectively applied to the manufacturing of clothes such as T-shirts, sweat shirts, aprons and jackets, cups, trays, stained glass, panels, and reproduced pictures which are made to order, or designed to be sold on a small scale, not by mass-production. Further, such demand has greatly expanded because high quality images can be more easily printed on the image-receiving members by using a full-color electrophotographic copying apparatus.

There is conventionally known an image transfer sheet for use with the image transfer method comprising the steps of forming a copied or printed image comprising a toner, thermofusible ink, sublimable dye or aqueous ink thereon and transferring the thus formed image to an image-receiving member, for instance, as disclosed in Japanese Laid-Open Patent Application 52-82509. According to this application, the image transfer sheet comprises a support, an adhesive layer formed thereon comprising an adhesive material selected from the group consisting of a silicone compound and a fluorine-containing polymer, and an undercoat layer (which is referred to as a transfer layer in the present invention) which is formed on the adhesive layer and comprises a specific low-temperature fusible polymer. As the low-temperature fusible polymer, there are disclosed vinyl chloride, vinyl acetate, methyl methacrylate, ethyl methacrylate, butyl methacrylate and vinylidene chloride; and mixtures, compounds and copolymers thereof. At the image transfer step, the image-bearing undercoat layer of the image transfer sheet is softened and completely transferred to an image-receiving member.

The above-mentioned conventional image transfer sheet can be stably stored at room temperature. However, when the ambient temperature increases to 50° C., the low-temperature fusible material for use in the undercoat layer is softened and the softened undercoat layer unfavorably tends to adhere to the support side of another image transfer sheet while the image transfer sheets are piled up during the storage. This causes a so-called blocking phenomenon.

The other drawback of the conventional image transfer sheet is that the image transfer sheet tends to curl during the storage, so that there easily occurs the problem of paper jam in the copying machine.

When a large amount of silicone oil is added to the undercoat layer of the image transfer sheet in order to eliminate the above-mentioned blocking phenomenon, a transporting roller in the copying machine cannot work normally due to slippage, which consequently induces the paper jam in the copying machine. There is an increasing demand for both the prevention of blocking phenomenon of the image transfer sheets during storage and the improvement of transporting performance of the image transfer sheets in the copying machine.

In the field of thermal image transfer recording, which is different from the technical field of the present invention, there is proposed in Japanese Laid-Open Patent Application 8-25788 a thermal image transfer ink ribbon comprising a release layer (corresponding to a backing layer of the image transfer sheet in the present invention) for eliminating the risk of blocking tendency of the image transfer ribbon. According to this application, a silicone material such as a copolymer or blend of silicone resin; and polyolefin, wax, alkyd resin, long-chain alkyl group containing resin, fluoroplastics and shellac are usable as the materials for use in the release layer. However, in this application, the release layer is provided in order to inhibit the blocking phenomenon, not in light of the prevention of curling and the improvement of transporting performance of the thermal image transfer ribbon in the image forming apparatus.

The conventional image transfer sheet has a further drawback that the adhesion of the undercoat layer thereof to various kinds of image-receiving members is insufficient. For instance, when an image formed on the image transfer sheet is transferred to a T-shirt made of cotton, the transferred image will peel off after repeated washing. In addition, when an image-transferred cloth is ironed after washing, the image on the cloth will soften and fuse again, so that the image will deform and stick to the surface of the iron. Namely, the fixing properties of the transferred image are still insufficient.

SUMMARY OF THE INVENTION

Accordingly, it is a first object of the present invention to provide an image transfer sheet which does not cause the blocking phenomenon during the storage thereof under the circumstances of high temperature, and does not curl during the storage thereof, thereby improving the transporting performance in the image forming apparatus.

A second object of the present invention is to provide an image transfer method using the above-mentioned image transfer sheet.

The above-mentioned first object of the present invention can be achieved by an image transfer sheet comprising a support, a transfer layer formed on one side of the support, and a backing layer formed on the other side of the support, opposite to the transfer layer with respect to the support, the backing layer comprising a silicone material which is in a solid state at room temperature.

The second object of the present invention can be achieved by an image transfer method using the above-mentioned image transfer sheet, comprising the steps of forming an image on the transfer layer side of the image transfer sheet, and bringing the image-bearing transfer layer of the image transfer sheet into contact with an image-receiving member by the application of heat and/or pressure thereto, thereby transferring the image-bearing transfer layer to the image-receiving member.

DESCRIPTION OF THE PREFERRED EMBODIMENTS

In the image transfer sheet of the present invention, a transfer layer is provided on one side of the support, and a backing layer comprising a silicone material which assumes a solid state at room temperature is provided on the other side of the support.

According to the image transfer method of the present invention, an image is first formed on the transfer layer of the image transfer sheet by the following methods (1) A toner image is transferred to the image transfer sheet and fixed thereon under the application of heat and/or pressure thereto by the electrophotographic process.

(2) An image is transferred imagewise from a thermofusible ink layer or a sublimable-dye-containing layer of a thermal image transfer recording medium to the image transfer sheet.

(3) An image comprising an aqueous ink or a thermofusible ink is formed on the image transfer sheet by ink-jet process.

The image-bearing surface of the image transfer sheet is brought into pressure contact with an image-receiving member under the application of heat thereto, and cooled to room temperature, and then, the support of the image transfer sheet is peeled from the transfer layer. Thus, the image can be transferred to the image-receiving member. To be more specific, a toner image, an ink image or a dye image can be fixedly formed on the transfer layer of the image transfer sheet of the present invention at the image forming step. At the subsequent image transfer step, when the image-bearing transfer layer of the image transfer sheet is brought into pressure contact with an image-receiving member under the application of heat, the image-bearing transfer layer is softened so as to exhibit sufficient adhesion to the image-receiving member. Then, the image transfer sheet is cooled to room temperature, and the image transfer sheet is removed from the image-receiving member. In this case, the image-bearing transfer layer is fixedly attached to the image-receiving member, so that the image transfer sheet is separated from the image-receiving member at the interface between the support and the transfer layer, or between a release layer and the transfer layer when a release layer is interposed between the support and the transfer layer in the image transfer sheet. Finally, the image-bearing transfer layer of the image transfer sheet is completely transferred and fixed to the surface of the image-receiving member.

The backing layer of the image transfer sheet according to the present invention comprises a silicone material which assumes a solid state at room temperature.

It is preferable that the silicone material for use in the backing layer of the image transfer sheet comprise a cold-setting silicone rubber, or a mixture of a cold-setting silicone rubber and a silicone resin. By using such a silicone material for the backing layer, the transfer layer of one image transfer sheet can be prevented from sticking to the backing layer of the other image transfer sheet when one image transfer sheet is overlaid on the other one.

The friction coefficient of silicone rubber is larger than that of silicone resin, so that the silicone rubber for use in the backing layer of the image transfer sheet has no adverse effect on transporting rollers in the image forming apparatus, such as a copying machine. Namely, the image transfer sheet does not cause slippage over the transporting roller in the course of transportation in the image forming apparatus.

The silicone material for use in the backing layer of the image transfer sheet assumes a solid state, not a liquid state, at room temperature. The silicone material which is in a liquid state at room temperature is easily attached to the surface of the transporting rollers in the image forming apparatus when used for the backing layer, so that the backing layer side of the image transfer sheet slips over the transporting roller and the image transfer sheet cannot be stably transported in the image forming apparatus. In addition, such a silicone material for use in the backing layer shifts to the transfer layer of the adjacent image transfer sheet during the storage. Therefore, the transfer layer side of the image transfer sheet becomes excessively slippery, so that the transporting performance of the image transfer sheet is lowered.

Specific examples of the silicone material for use in the backing layer are methyl silicone resin, phenylmethyl silicone resin, silicone alkyd resin, silicone epoxy resin, polyester-modified silicone resin, urethane-modified silicone resin acryl-modified silicone resin, melamine-modified silicone resin, phenol-modified silicone resin, dimethyl silicone rubber, methylvinyl silicone rubber, and methylphenyl silicone rubber. These silicone materials may be used alone or in combination.

As mentioned above, a cold-setting silicone rubber, or a mixture of a cold-setting silicone rubber and a silicone resin is preferably employed in the backing layer when consideration is given to the prevention of blocking phenomenon and the stable transporting performance in the image forming apparatus. In this case, it is preferable that the amount ratio by weight of the cold-setting silicone rubber to the silicone resin be in the range of (100:0) to (20:80). When the amount ratio of the silicone resin is within the above-mentioned range, the blocking phenomenon can be prevented effectively.

The backing layer of the image transfer sheet may further comprise the following materials so long as the benefits of the present invention are not impaired: thermoplastic polyurethane, polyamide, polyester, polyolefin, cellulose derivative such as cellulose nitrate, styrene resins and styrene copolymers such as polystyrene and poly-α-methylstyrene, acrylic resins such as methyl polyacrylate, methyl polymethacrylate, ethyl polyacrylate and ethyl polymethacrylate, vinyl copolymers such as vinyl chloride—vinyl acetate copolymer and ethylene—vinyl alcohol copolymer, rosin and rosin ester resins such as rosin-modified maleic acid resin, natural and synthetic rubbers such as polyisoprene rubber and styrene butadiene rubber, a variety of ionomers, epoxy resin and phenolic resin.

The above-mentioned thermoplastic polyurethane is obtained from the reaction between an isocyanate and a polyol having hydroxyl group at the end of a molecule thereof.

In this case, examples of the isocyanate for producing the polyurethane are aromatic diisocyanates such as tolylene diisocyanate and diphenylmethane-4,4'-diisocyanate; aliphatic cyclic diisocyanates such as isophorone diisocyanate; and aliphatic diisocyanates such as trimethylene diisocyanate, tetramethylene diisocyanate, hexamethylene diisocyanate and dodecamethylene diisocyanate.

As the polyol for producing the polyurethane, at least one polyhydroxy compound is employed. Examples of such a polyhydroxy compound include alkane polyols such as alkane diols, for example, 1,5-pentanediol, 1,8-octanediol, 1,10-decanediol and 1,12-dodecanediol; polyester polyols such as aliphatic polyester diols, for example, a polyester diol comprising as a constituent unit at least an aliphatic diol or an aliphatic dicarboxylic acid, and polyether polyols such as polyether diols, for example, diethylene glycol, triethylene glycol, polyethylene glycol, tripropylene glycol, polypropylene glycol, and an adduct of bisphenol A with an alkylene oxide such as ethylene oxide.

As the polyamide for use in the backing layer of the image transfer sheet, there can be employed nylon 6, nylon 11, nylon 12, nylon 13, nylon 610, nylon 612, nylon 616, and copolymer nylon comprising those nylon materials, such as nylon 6/12.

With respect to the polyester for use in the backing layer, it is preferable to employ a polyester comprising at least an aliphatic diol component or an aliphatic dicarboxylic acid component, more preferably, both the aliphatic diol component and the aliphatic dicarboxylic acid component. It is further preferable that a saturated aliphatic dicarboxylic acid component be used in the polyester.

Specific examples of the aliphatic diol component for use in the polyester are ethylene glycol, diethylene glycol, triethylene glycol, polyethylene glycol, propylene glycol, dipropylene glycol, tripropylene glycol, polypropylene glycol, 1,3-butanediol, 1,4-butanediol, neopentyl glycol, 1,6-hexanediol, and polymethylene glycol.

Specific examples of the aliphatic dicarboxylic acid component for use in the polyester include unsaturated aliphatic dicarboxylic acids such as maleic acid and fumaric acid; and saturated aliphatic dicarboxylic acids such as succinic anhydride, adipic acid, azelaic acid, sebacic acid, suberic acid and dodecanedioic acid.

Examples of the previously mentioned polyolefin for use in the backing layer are polyethylene such as low-density polyethylene and straight-chain low-density polyethylene, ethylene - butene-1 copolymer, ethylene -(4-methylpentene-1) copolymer, ethylene - vinyl acetate copolymer, ethylene - (meth)acrylic acid copolymer, ethylene - (meth)acrylate copolymer, propylene - butene-1 copolymer, ethylene - propylene copolymer, ethylene - propylene - butene-1 copolymer, and modified polyolefin such as maleic anhydride.

Of these polyolefins, the modified polyolefin is preferably employed for the backing layer.

It is preferable that the deposition amount of the backing layer be in the range of 0.1 to 10 g/m$^2$, more preferably in the range of 0.3 to 5 g/m$^2$ on a dry basis. When the deposition amount of the backing layer is within the above-mentioned range, the backing layer can effectively function to prevent the blocking phenomenon and improve the transporting performance.

In order to enhance the transferring properties of the transfer layer to the image-receiving member, the image transfer sheet of the present invention may further comprise a release layer which is interposed between the support and the transfer layer.

It is preferable that the release layer comprise a silicone compound, more preferably, a silicone rubber, and further preferably, a cold-setting silicone rubber, from the viewpoint of release characteristics. To be more specific, at least one of the previously mentioned silicone materials for use in the backing layer may be contained in the release layer. Further, so long as the benefits of the present invention are not impaired, the materials for use in the backing layer may be contained in the release layer.

It is preferable that the deposition amount of the release layer be in the range of 0.05 to 5.0 g/m$^2$ on a dry basis. When the deposition amount of the release layer is within the above-mentioned range, proper release characteristics can be obtained.

The transfer layer of the image transfer sheet according to the present invention may comprise a self-crosslinking polymer. In such a case, when the image-bearing transfer layer of the image transfer sheet is transferred to an image-receiving member with the application of heat and pressure thereto, the crosslinking proceeds in the transfer layer by the application of heat thereto. Therefore, the image-bearing transfer layer does not easily fuse again even by the application of heat thereto after transferred to the image-receiving member. Even when the image-bearing transfer layer transferred to the image-receiving member is heated again, for example, by ironing, the crosslinking further proceeds in the transfer layer, so that the transfer layer does not readily soften and fuse. Thus, the heat resistance and the fixing properties of the transferred image are remarkably improved.

As the self-crosslinking polymers for use in the transfer layer, there can be employed polymers comprising methylol group, alkoxymethyl group, carboxyl group, epoxy group, hydroxyl group, amide group, methylolacrylamide group and vinyl group as the self-crosslinking moieties. Of those polymers, the polymer comprising methylol group and/or alkoxymethyl group is preferably employed in the transfer layer because not only the preservation stability of the image transfer sheet is improved, but also the crosslinking reactivity in the transfer layer is sufficient while the image transfer step is carried out under the application of heat. A more preferable self-crosslinking polymer for use in the transfer layer is ethylene - vinyl acetate - acryl copolymer resin comprising methylol group and/or alkoxymethyl group as a self-crosslinking moiety.

In light of the heat-resistant preservation stability of the image transfer sheet, and the crosslinking reactivity at the image transfer step, the temperature for the crosslinking reaction may be in the range of 80 to 250° C.

It is preferable that the molecular weight of the above-mentioned self-crosslinking polymer for use in the transfer layer be in the range of 10,000 to 500,000 in terms of the fixing properties of the transfer layer at the image transfer step.

Both the fixing performance of the transferred image and the transporting performance of the image transfer sheet in any of the image forming apparatus can be upgraded by employing a self-crosslinking polymer with a glass transition temperature of 0° C. or more in combination with the one with a glass transition temperature of 0° C. or less in the transfer layer of the image transfer sheet, and/or employing a self-crosslinking polymer with a molecular weight of 10,000 to 500,000 in combination with the one with a molecular weight of 10,000,000 to 60,000,000 in the transfer layer of the image transfer sheet. In the above case, it is preferable that the amount ratio by weight of the self-crosslinking polymer with a glass transition temperature of 0° C. or more to the one with a glass transition temperature of 0° C. or less be in the range of (1:10) to (10:1). Further, it is preferable that the amount ratio by weight of the self-crosslinking polymer with a molecular weight of 10,000 to 500,000 to the one with a molecular weight of 10,000,000 to 60,000,000 be in the range of (1:10) to (10:1).

In light of the transferring properties of the transfer layer of the image transfer sheet and the fixing performance of the transferred image to the image-receiving member, it is preferable that the deposition amount of the transfer layer be in the range of 5 to 200 g/m$^2$ on a dry basis. Namely, when the deposition amount is 5 g/m$^2$ or more, the transferred image can be sufficiently stably fixed on the image-receiving member. On the other hand, when the deposition amount is 200 g/m$^2$ or less, the transfer layer of the image transfer sheet can be readily transferred to the image-receiving member at the image transfer step.

In addition to the above-mentioned self-crosslinking crosslinking polymer, the same additives as employed in the backing layer may be contained in the transfer layer of the image transfer sheet so long as the benefits of the present invention are not impaired.

Further, the transfer layer may further comprise a tackifier, antioxidant, ultraviolet absorbing agent, coloring agent, antistatic agent, flame-retardant, wax, plasticizer and filler when necessary.

According to the present invention, when a cold-setting silicone rubber is used for the release layer, and a cold-setting silicone rubber or a mixture of a cold-setting silicone rubber and a silicone resin Is used for the backing layer, the preparation of the release layer and backing layer does not need any application of heat, thereby reducing the manufacturing cost of the image transfer sheet.

Further, by using the cold-setting silicone rubber for the release layer, the crosslinking density in the release layer is sufficiently high, so that the risk of heat fusion of the release layer to the composition of the transfer layer can be eliminated when the transfer layer is transferred to the image-receiving member under the application of heat and pressure thereto. Even when the image transfer sheet is cooled after the image-bearing transfer layer is transferred to the image-receiving member, the interface between the release layer and the transfer layer can be maintained in the initial condition, so that the release layer can be smoothly separated from the transfer layer after the image transfer step. Therefore, it is not necessary to separate the release layer from the transfer layer in a hurry before the image transfer sheet is cooled. In the case where the transfer layer bears thereon an image with a large area, the large image can be uniformly transferred to the image-receiving member with high image quality. This is because the transferring properties of the image-bearing transfer layer are remarkably stable regardless of the change in temperature while the release layer is separated from the image-bearing transfer layer.

In the preparation of the image transfer sheet of the present invention, it is preferable to use an aqueous emulsion of the cold-setting silicone rubber for the formation of the release layer; an aqueous emulsion of the self-crosslinking polymer for the formation of the transfer layer; and an aqueous emulsion of the cold-setting silicone rubber or a mixture of the cold-setting silicone rubber and the silicone resin for the formation of the backing layer. By use of such an aqueous emulsion, evaporation of an organic solvent can be eliminated in the course of preparation of the image transfer sheet. Therefore, the image transfer sheet can be manufactured at low cost without impairing the environmental health.

Examples of the support for use in the image transfer sheet of the present invention include paper; synthetic paper; cloth; non-woven sheet; leather; a sheet made of a resin such as polyethylene terephthalate, diacetate cellulose, triacetate cellulose, acrylic polymer, cellophane, celluloid, polyvinyl chloride, polycarbonate, polyimide, polyether sulfone, polyethyl ether ketone, polyethylene or polypropylene; and metallic plate and metallic foil. In addition, the above-mentioned support materials may be laminated to prepare a composite film, and further, the water resistance and electroconductivity may be imparted to the support material by coating or laminating method. The material for the support is not particularly limited as mentioned above. In particular, a sheet of paper with a basis weight of 20 to 200 g/m$^2$ is preferably employed in the present invention from the viewpoint of economic factor and the stability of transporting performance in the image forming apparatus.

To form the release layer and the transfer layer, the materials constituting each layer are dissolved or dispersed in water or an appropriate solvent, or an emulsion may be prepared, thereby obtaining a coating liquid for the release layer or the transfer layer. The thus prepared coating liquid may be coated on the support using a coater such as roll coater, blade coater, wire bar coater, air-knife coater, or rod coater. Alternatively, the release layer or the transfer layer may be overlaid on the support using a hot-melt coater or laminate coater.

In the present invention, images can be formed on the image transfer sheet not only by the electrophotographic recording method, thermal image transfer recording method using a thermofusible ink or sublimation-type dye, and ink-jet process, as mentioned above, but also by various printing processes such as offset printing, letterpress printing, intaglio printing and stencil printing, and various recording methods such as electrostatic recording, dot impact recording and handwriting.

Other features of this invention will become apparent in the course of the following description of exemplary embodiments, which are given for illustration of the invention and are not intended to be limiting thereof.

EXAMPLE 1

[Formation of Release Layer]

The following components were mixed to prepare a coating liquid for a release layer:

| | Parts by Weight |
|---|---|
| Cold-setting silicone rubber emulsion "SE-1980 Clear" (Trademark), made by Dow Corning Toray Silicone Co., Ltd. (Solid content: 45%) | 10 |
| Water | 40 |

Using a wire bar, the above prepared coating liquid for the release layer was coated on one side of a sheet of high quality paper with a basis weight of 104.7 g/m$^2$ serving as a support, and dried. Thus, a release layer with a deposition amount of 1.7 g/m$^2$ on a dry basis was provided on the support.

[Formation of transfer layer]

The following components were mixed to prepare a coating liquid for a transfer layer:

| | Parts by Weight |
|---|---|
| Methylol containing self-crosslinking ethylene-vinyl acetate-acryl copolymer resin emulsion "Polysol EF-421", (Trademark), made by Showa Highpolymer Co., Ltd. (Tg: −21° C., solid content: 45%, molecular weight: 100,000–200,000, and crosslinking temperature: 120° C. or more) | 10 |
| Methylol containing self-crosslinking ethylene-vinyl acetate-acryl copolymer resin emulsion "Polysol EF-250N" (Trademark), made by Showa Highpolymer Co., Ltd. (Tg: 20° C., solid content: 50%, molecular weight: 100,000–200,000, and crosslinking temperature: 120° C. or more) | 10 |

The above-prepared coating liquid for the transfer layer was coated on the release layer by a wire bar, and dried, so that a transfer layer with a deposition amount of 30 g/m$^2$ on a dry basis was provided on the release layer.

[Formation of backing layer]

The following components were mixed to prepare a coating liquid for a backing layer;

| | Parts by Weight |
|---|---|
| Cold-setting silicone rubber emulsion "SE-1980 Clear" (Trademark), made by Dow Corning Toray Silicone Co., Ltd. (solid content: 45%) diluted with water at a ratio by weight of 1:4. | 9 |
| Silicone resin emulsion "SM-7706", made by Dow Corning Toray Silicone Co., Ltd. (solid content: 35%) diluted with water at a ratio by weight of 1:4. | 6 |

The above-prepared coating liquid for the backing layer was coated by a wire bar on the other side of the support, opposite to the release layer with respect to the support, and dried, so that a backing layer with a deposition amount of 2.2 g/m$^2$ on a dry basis was provided on the back side of the support. Thus, an image transfer sheet No. 1 according to the present invention was prepared.

Using a commercially available color copying machine "PRETER 550" (Trademark), made by Ricoh Company, Ltd., a full-color image was formed on the transfer layer side of the above prepared image transfer sheet No. 1. The full-color image thus formed was remarkably clear, and by no means inferior to an image formed on a sheet of plain paper.

The full-color image bearing surface of the image transfer sheet No. 1 was brought into contact with a white cotton cloth, and pressure was applied thereto at 160° C. for 15 seconds using a commercially available thermal transfer press "Rotary Press" (Trademark), made by Mainichi Mark Co., Ltd. Thereafter, the image transfer sheet No. 1 and the cotton cloth to which the image transfer sheet was attached were cooled to room temperature, and the image transfer sheet No. 1 was peeled from the cotton cloth. As a result, the full-color image bearing transfer layer was completely transferred to the cloth, with no image remaining on the high quality paper serving as the support of the image transfer sheet No. 1. The transferring properties of the image-bearing transfer layer were excellent, and the clear high quality image was transferred to the surface of the white cotton cloth.

EXAMPLE 2

The procedure for preparation of the image transfer sheet No. 1 according to the present invention in Example 1 was repeated except that the deposition amount of the backing layer was changed from 2.2 to 0.6 g/m$^2$ on a dry basis. Thus, an image transfer sheet No. 2 according to the present invention was prepared.

A full-color image was formed on the image transfer sheet No. 2, and the full-color image bearing transfer layer of the image transfer sheet was transferred to the white cotton cloth in the same manner as in Example 1.

The transferring properties of the image-bearing transfer layer were satisfactory.

EXAMPLE 3

The procedure for preparation of the image transfer sheet No. 1 according to the present invention in Example 1 was repeated except that the deposition amount of the backing layer was changed from 2.2 to 7.0 g/m$^2$ on a dry basis. Thus, an image transfer sheet No. 3 according to the present invention was prepared.

A full-color image was formed on the image transfer sheet No. 3, and the full-color image bearing transfer layer of the image transfer sheet was transferred to the white cotton cloth in the same manner as in Example 1.

The transferring properties of the image-bearing transfer layer were satisfactory.

EXAMPLE 4

The procedure for preparation of the image transfer sheet No. 1 according to the present invention in Example 1 was repeated except that the silicone resin emulsion diluted with water in the composition of the backing layer in Example 1 was eliminated therefrom. Thus, an image transfer sheet No. 4 according to the present invention was prepared.

A full-color image was formed on the image transfer sheet No. 4, and the full-color image bearing transfer layer of the image transfer sheet was transferred to the white cotton cloth in the same manner as in Example 1.

The transferring properties of the image-bearing transfer layer were satisfactory.

EXAMPLE 5

The procedure for preparation of the image transfer sheet No. 1 according to the present invention in Example 1 was repeated except that the formulation for the backing layer was changed as follows:

| | Parts by Weight |
|---|---|
| Cold-setting silicone rubber emulsion "SE-1980 Clear" (Trademark), made by Dow Corning Toray Silicone Co., Ltd. (solid content: 45%) diluted with water at a ratio by weight of 1:4. | 80 |
| Silicone resin emulsion "5M-7706", made by Dow Corning Toray Silicone Co., Ltd. (solid content: 35%) diluted with water at a ratio by weight of 1:4. | 24 |

Thus, an image transfer sheet No. 5 according to the present invention was prepared.

A full-color image was formed on the image transfer sheet No. 5, and the full-color image bearing transfer layer of the image transfer sheet was transferred to the white cotton cloth in the same manner as in Example 1.

The transferring properties of the image-bearing transfer layer were satisfactory.

EXAMPLE 6

The procedure for preparation of the image transfer sheet No. 1 according to the present invention in Example 1 was repeated except that the formulation for the backing layer was changed as follows:

| | Parts by Weight |
|---|---|
| Cold-setting silicone rubber emulsion "SE-1980 Clear" (Trademark), made by Dow Corning Toray Silicone Co., Ltd. (solid content: 45%) diluted with water at a ratio by weight of 1:4. | 50 |
| Silicone resin emulsion "SM-7706", made by Dow Corning Toray Silicone Co., Ltd. (solid content: 35%) diluted with water at a ratio by weight of 1:4. | 56 |

Thus, an image transfer sheet No. 6 according to the present intention was prepared.

A full-color image was formed on the image transfer sheet No. 6, and the full-color image bearing transfer layer of the image transfer sheet was transferred to the white cotton cloth in the same manner as in Example 1.

The transferring properties of the image-bearing transfer layer were satisfactory.

EXAMPLE 7

The procedure for preparation of the image transfer sheet No. 1 according to the present invention in Example 1 was repeated except that the formulation for the backing layer was changed as follows:

| | Parts by Weight |
|---|---|
| Cold-setting silicone rubber emulsion "SE-1980 Clear" | 20 |

-continued

| | Parts by Weight |
|---|---|
| (Trademark), made by Dow Corning Toray Silicone Co., Ltd. (solid content: 45%) diluted with water at a ratio by weight of 1:4. | |
| Silicone resin emulsion "SM-7706", made by Dow Corning Toray Silicone Co., Ltd. (solid content: 35%) diluted with water at a ratio by weight of 1:4. | 84 |

Thus, an image transfer sheet No. 7 according to the present invention was prepared.

A full-color image was formed on the image transfer sheet No. 7, and the full-color image bearing transfer layer of the image transfer sheet was transferred to the white cotton cloth in the same manner as in Example 1.

The transferring properties of the image-bearing transfer layer were satisfactory.

EXAMPLE 8

The procedure for preparation of the image transfer sheet No. 1 according to the present invention in Example 1 was repeated except that the formulation for the backing layer was changed as follows:

| | Parts by Weight |
|---|---|
| Cold-setting silicone rubber emulsion "SE-1980 Clear" (Trademark), made by Dow Corning Toray Silicone Co., Ltd. (solid content: 45%) diluted with water at a ratio by weight of 1.4. | 94 |
| Acrylate-silicone copolymer emulsion "ROY-6312" (Trademark), made by Showa Highpolymer Co., Ltd. (solid content: 38%), diluted with water at a ratio by weight of 1:4. | 6 |

Thus, an image transfer sheet No. 8 according to the present invention was prepared.

A full-color image was formed on the image transfer sheet No. 8, and the full-color image bearing transfer layer of the image transfer sheet was transferred to the white cotton cloth in the same manner as in Example 1.

The transferring properties of the image-bearing transfer layer were satisfactory.

COMPARATIVE EXAMPLE 1

The procedure for preparation of the image transfer sheet No. 1 according to the present invention in Example 1 was repeated except that the backing layer was not provided on the back side of the support. Thus, a comparative image transfer sheet No. 1 was prepared.

A full-color image was formed on the comparative image transfer sheet No. 1, and the full-color image bearing transfer layer of the image transfer sheet was transferred to the white cotton cloth in the same manner as in Example 1.

The transferring properties of the image-bearing transfer layer were satisfactory.

COMPARATIVE EXAMPLE 2

The procedure for preparation of the image transfer sheet No. 1 according to the present invention in Example 1 was repeated except that the formulation for the backing layer was changed as follows:

| | Parts by Weight |
|---|---|
| 10% aqueous solution of oxidized starch (made by Matsutani Kagaku Kogyo Co., Ltd.) | 94 |

Thus, a comparative image transfer sheet No. 2 was prepared.

A full-color image was formed on the comparative image transfer sheet No. 2, and the full-color image bearing transfer layer of the image transfer sheet was transferred to the white cotton cloth in the same manner as in Example 1.

The transferring properties of the image-bearing transfer layer were satisfactory.

COMPARATIVE EXAMPLE 3

The procedure for preparation of the image transfer sheet No. 1 according to the present invention in Example 1 was repeated except that the formulation for the backing layer was changed as follows:

| | Parts by Weight |
|---|---|
| 20% solution of polyvinyl alcohol "PVA205" (Trademark), made by Kuraray Co., Ltd. | 19 |
| Silicone oil "KF6004" (Trademark), made by Shin-Etsu Silicone Co., Ltd. | 5 |
| Water | 76 |

Thus, a comparative image transfer sheet No. 3 was prepared.

A full-color image was formed on the comparative image transfer sheet No. 3, and the full-color image bearing transfer layer of the image transfer sheet was transferred to the white cotton cloth in the same manner as in Example 1.

The transferring properties of the image-bearing transfer layer were satisfactory.

In addition, to examine the blocking resistance of each image transfer sheet, one image transfer sheet was overlaid on another image transfer sheet in such a fashion that the transfer layer of the lower image transfer sheet was in contact with the backing layer of the upper image transfer sheet, and a load of 1 kg was applied to the two image transfer sheets from the above, and the two sheets were allowed to stand at 50° C. for 62 hours. Then, the blocking resistance of the image transfer sheet was evaluated on the following scales:

⊙: There was no blocking tendency.

○: The image transfer sheets were partially attached to each other, but the quality of image transfer sheets was acceptable for practical use after peeling.

Δ: The image transfer sheets were partially attached to each other, and the quality of image transfer sheets was not acceptable for practical use after peeling.

x: The image transfer sheets were completely attached to each other, and the transfer layer of one image transfer sheet peeled off when the one image transfer sheet was separated from another image transfer sheet.

The results are shown in TABLE 1.

Furthermore, the transporting performance of each image transfer sheet was examined by allowing the image transfer sheets to transport in the commercially available copying machine "PRETER 550" (Trademark), made by Ricodh Company, Ltd.

The transporting performance was evaluated on the following scales:

○: There was no problem with respect to the transporting performance in the copying machine.

Δ: There occurred some problems with respect to the transporting performance under the circumstances of low temperature (10° C.) and low humidity (10% RH).

x: There occurred some problems with respect to the transporting performance under the circumstances of room temperature (20 C.) and normal humidity (50% RH).

The results are also shown in TABLE 1.

TABLE 1

| | Deposition Amount of Backing Layer ($g/m^2$) | Ratio by Weight of Silicone Rubber in Backing Layer (%) | Blocking Resistance of Image Transfer Sheet | Transporting Performance of Image Transfer Sheet |
|---|---|---|---|---|
| Ex. 1 | 2.2 | 95 | ⊙ | ○ |
| Ex. 2 | 0.6 | 95 | ⊙ | ○ |
| Ex. 3 | 7.0 | 95 | ⊙ | ○ |
| Ex. 4 | 2.2 | 100 | ○ | ○ |
| Ex. 5 | 2.2 | 80 | ⊙ | ○ |
| Ex. 6 | 2.2 | 50 | ⊙ | ○ |
| Ex. 7 | 2.2 | 20 | ⊙ | ○ |
| Ex. 8 | 2.2 | 95 | ⊙ | ○ |
| Comp. Ex. 1 | — | — | x | ○ |
| Comp. Ex. 2 | 2.2 | 0 | x | ○ |
| Comp. Ex. 3 | 2.2 | 0 | Δ | ○ |

As previously explained, the image transfer sheet according to the present invention does not cause blocking while stored under the circumstances of high temperature, and in addition, the curling of image transfer sheet can be inhibited, so that there occurs no problem with respect to the transporting performance of the image transfer sheet in the image forming apparatus.

Japanese Patent Application No. 09-132228 filed May 22, 1997 and Japanese Patent Application No. 10-135399 filed May 18, 1998 are hereby incorporated by reference.

What is claimed is:

1. An image transfer sheet comprising a support, a transfer layer formed on one side of said support, and a backing layer formed on the other side of said support, opposite to said transfer layer with respect to said support, said backing layer comprising a cold-setting silicone material which is in a solid state at room temperature.

2. The image transfer sheet as claimed in claim 1, further comprising a release layer which is interposed between said support and said transfer layer.

3. The image transfer sheet as claimed in claim 1, wherein said silicone material for use in said backing layer comprises a cold-setting silicone rubber and a silicone resin.

4. The image transfer sheet as claimed in claim 1, wherein said backing layer is provided on said support in a deposition amount of 0.1 to 10 $g/m^2$ on a dry basis.

5. An image transfer method using an image transfer sheet comprising a support, a transfer layer formed on one side of said support, and a backing layer formed on the other side of said support, opposite to said transfer layer with respect to said support, said backing layer comprising a cold-setting silicone material which is in a solid state at room temperature, said image transfer method comprising the steps of:

forming an image on said transfer layer of said image transfer sheet, and bringing said image-bearing transfer layer of said image transfer sheet into contact with an image-receiving member under the application of heat and/or pressure thereto, thereby transferring said image-bearing transfer layer to said image-receiving member.

6. The image transfer method as claimed in claim 5, wherein said image transfer sheet further comprises a release layer which is interposed between said support and said transfer layer.

7. The image transfer method as claimed in claim 5, wherein said silicone material for use in said backing layer comprises a cold-setting silicone rubber and a silicone resin.

8. The image transfer method as claimed in claim 5, wherein said backing layer is provided on said support in a deposition amount of 0.1 to 10 $g/m^2$ on a dry basis.

9. The image transfer method as claimed in claim 5, wherein said image on said image transfer sheet is a toner image formed by the electrophotographic process.

10. The image transfer method as claimed in claim 5, wherein said image on said image transfer sheet is a thermofusible ink image or a sublimable dye image formed by thermal image transfer recording method.

11. The image transfer method as claimed in claim 5, wherein said image on said image transfer sheet is an aqueous ink image or a thermofusible ink image formed by ink-jet process.

* * * * *

UNITED STATES PATENT AND TRADEMARK OFFICE

CERTIFICATE OF CORRECTION

PATENT NO. : 6,103,042
DATED : August 15, 2000
INVENTOR(S) : Shigeo Hatada, et al.

It is certified that error appears in the above-identified patent and that said Letters Patent is hereby corrected as shown below:

Column 5,
Line 13, "," should read -- ; -- after "acid".

Column 7,
Line 28, "Is" should read -- is -- after "silicon resin".

Column 12,
Line 37, "1.4" should read -- 1:4 -- after "by weight of".

Signed and Sealed this

Thirteenth Day of November, 2001

*Attest:*

Nicholas P. Godici

*Attesting Officer*

NICHOLAS P. GODICI
*Acting Director of the United States Patent and Trademark Office*